US011506088B2

(12) United States Patent
Rabovitser et al.

(10) Patent No.: US 11,506,088 B2
(45) Date of Patent: Nov. 22, 2022

(54) HYDRO-TURBINE DRIVE METHODS AND SYSTEMS FOR APPLICATION FOR VARIOUS ROTARY MACHINERIES

(71) Applicant: GAS TECHNOLOGY INSTITUTE, Des Plaines, IL (US)

(72) Inventors: Joseph Rabovitser, Skokie, IL (US); David Cygan, Villa Park, IL (US); Hamid Abbasi, Naperville, IL (US)

(73) Assignee: GAS TECHNOLOGY INSTITUTE, Des Plaines, IL (US)

( * ) Notice: Subject to any disclaimer, the term of this patent is extended or adjusted under 35 U.S.C. 154(b) by 363 days.

(21) Appl. No.: 16/450,603

(22) Filed: Jun. 24, 2019

(65) Prior Publication Data

US 2019/0390573 A1 Dec. 26, 2019

Related U.S. Application Data

(60) Provisional application No. 62/688,504, filed on Jun. 22, 2018.

(51) Int. Cl.
*F01K 3/18* (2006.01)
*F01K 21/00* (2006.01)
*F01K 7/16* (2006.01)

(52) U.S. Cl.
CPC ..... *F01K 3/185* (2013.01); *F01K 7/16* (2013.01); *F01K 21/005* (2013.01)

(58) Field of Classification Search
CPC ..... F02C 1/08; F02C 1/10
USPC ..... 60/643–684, 641.1–641.15, 698–720, 60/597–624, 272–324
See application file for complete search history.

(56) References Cited

U.S. PATENT DOCUMENTS 4,272,961 A * 6/1981 Sadhukhan ..... F28F 13/125 165/111
4,589,258 A * 5/1986 von Bockh ..... F22G 1/005 60/679
4,593,527 A * 6/1986 Nakamoto ..... B60H 1/00007 60/660
2005/0172631 A1* 8/2005 Primlani ..... F23R 7/00 60/698
2009/0025387 A1* 1/2009 Willson ..... F01K 23/10 60/653
2011/0048009 A1* 3/2011 Smith ..... F01K 23/04 60/645
2011/0279110 A1* 11/2011 Pieszchala ..... F01K 13/02 324/207.25
2013/0283790 A1* 10/2013 Rewers ..... F01K 3/22 60/615
2013/0285379 A1* 10/2013 Seeley ..... H02N 3/00 290/52

(Continued)

FOREIGN PATENT DOCUMENTS

JP 61223204 A * 10/1986 ..... F01K 9/026

*Primary Examiner* — Mickey H France
(74) *Attorney, Agent, or Firm* — Pauley Erickson & Swanson

(57) ABSTRACT

This invention relates generally to hydro-turbine drive methods and systems and, more particularly, to hydro-turbine drive methods and systems such as for application for various rotary machineries including producing a high pressure fluid with at least one fluid pump by utilizing a fluid heater to create a fluid and vapor mixture for producing mechanical shaft power.

29 Claims, 8 Drawing Sheets

(56) References Cited

U.S. PATENT DOCUMENTS

| | | | | |
|---|---|---|---|---|
| 2013/0318973 | A1* | 12/2013 | Takahashi | F01D 5/145<br>60/726 |
| 2014/0250912 | A1* | 9/2014 | Huntington | F01K 17/025<br>60/783 |
| 2015/0089945 | A1* | 4/2015 | Wildman | F22B 1/006<br>60/641.8 |
| 2015/0267567 | A1* | 9/2015 | Clements | F01K 25/08<br>60/671 |
| 2017/0159501 | A1* | 6/2017 | Brookman | B60K 3/02 |

* cited by examiner

HYDRO-TURBINE DRIVE METHODS AND SYSTEMS FOR APPLICATION FOR VARIOUS ROTARY MACHINERIES

BACKGROUND OF THE INVENTION

Field of the Invention

This invention relates generally to hydro-turbine drive methods and systems and, more particularly, to hydro-turbine drive methods and systems such as for application for various rotary machineries.

Description of Related Art

Electric Motor-Driven Systems (EMDS) are used in a wide range of industrial applications, water/wastewater processing facilities, as well as in many types of applications in the commercial, residential, agricultural and transportation sectors. In such systems, electric motors are typically a component in a motor system, responsible for converting electrical power into mechanical power. Energy consumption of a motor system generally corresponds to electricity consumption of its motors plus a small additional quantity to power variable speed drive (VSD) and system controls.

EMDS are the single largest electrical end-use, consuming more than twice as much electricity as lighting, the next largest end-use. It is estimated by the International Energy Agency (IEA) that EMDS account for between 43% and 46% of all electricity consumption.

For a fossil fuel power unit, fuel to electricity (at a generator output) thermal efficiency is about 34% Low Heating Value (LHV). Assuming transmission and distribution losses, high and low voltage transformers, VSD and controls are together about 17% LHV. Electric motor efficiency is about 93%, with the ultimate efficiency of fuel energy to mechanical energy to an end-use rotary unit at about 25%.

Thus, there is a need and a demand for power and drive systems that minimize and desirably overcome EMDS drawbacks.

SUMMARY OF THE INVENTION

The subject invention provides an innovative Hydro-Turbo Drive System (HTDS) that minimizes and/or overcomes EMDS drawbacks and can be used as an alternative or replacement to EMDS.

In accordance with one aspect of the invention, a method of driving a rotary machinery end-use unit either directly, or through a gearbox connected to the rotary machinery unit, is provided. In one embodiment, such a method involves producing high pressure (HP) water (or another liquid) by a HP water pump driven by a primary mover. Alternate means to pressurize water, using thermal energy for example, may also be used. For the purposes of this application, "HP water pump" is used to describe all methods of pressurizing a fluid. The HP water may be supplied to a HP water storage unit where a required stable pressure is either maintained or used directly. Depending on its temperature, the HP water from the storage unit or the HP water pump is supplied to a water heater where the water is preheated to its boiling temperature and is partially evaporated to about 5-20% of vapor, forming a high pressure water/vapor (water/steam) mixture. The moisture may also be generated separately and introduced into the HP water. If the HP water is at or above its boiling point, for example if the pressure is generated by heating the water, the moisture may be introduced by partial condensation using a cold object or a cooled water stream. The produced HP water/vapor (water/steam) mixture is supplied to a hydro-turbine to produce mechanical shaft power. The mechanical shaft power is transferred from the hydro-turbine to a rotary machinery end-use unit. A resulting outlet low pressure (LP) water from the hydro-turbine is supplied to a LP water storage unit and LP water from the LP water storage unit is supplied to the inlet of the HP water pump to close a system water loop. Alternately, the LP water may be supplied directly to the inlet of the HP water pump.

It should be understood that while the description here uses a mechanical water pump driven by a prime mover, the HP water pump may also be thermally driven, for example by heating water to generate high pressure water. Also, while the description here uses intermediate HP and LP water storage, the HP and LP water can also be used directly without storage.

In accordance with another aspect of the invention, a system for driving rotary machineries is provided. In one embodiment, such a system includes a HP water generation module, a water storage module and a hydro-turbine drive module.

HP water produced in the HP water generation module (Module 1) is fed to the storage module (Module 2), where constant pressure is maintained such as by using a very small amount of compressed air. From the storage module, the HP water is supplied to each of the hydro-turbines (Module 3) that provide mechanical power to end-use rotary machineries.

A system for driving rotary machineries, in accordance with one particular embodiment, includes a hydro-power generation unit, HP and LP liquid (water) storages, and a hydro-turbine connected to the rotary machinery unit. The system drives the rotary machineries either directly or through a gearbox connected to the rotary machinery unit.

BRIEF DESCRIPTION OF THE DRAWINGS

Objects and features of this invention will be better understood from the following description taken in conjunction with the drawings, wherein.

DETAILED DESCRIPTION

Figure 1:
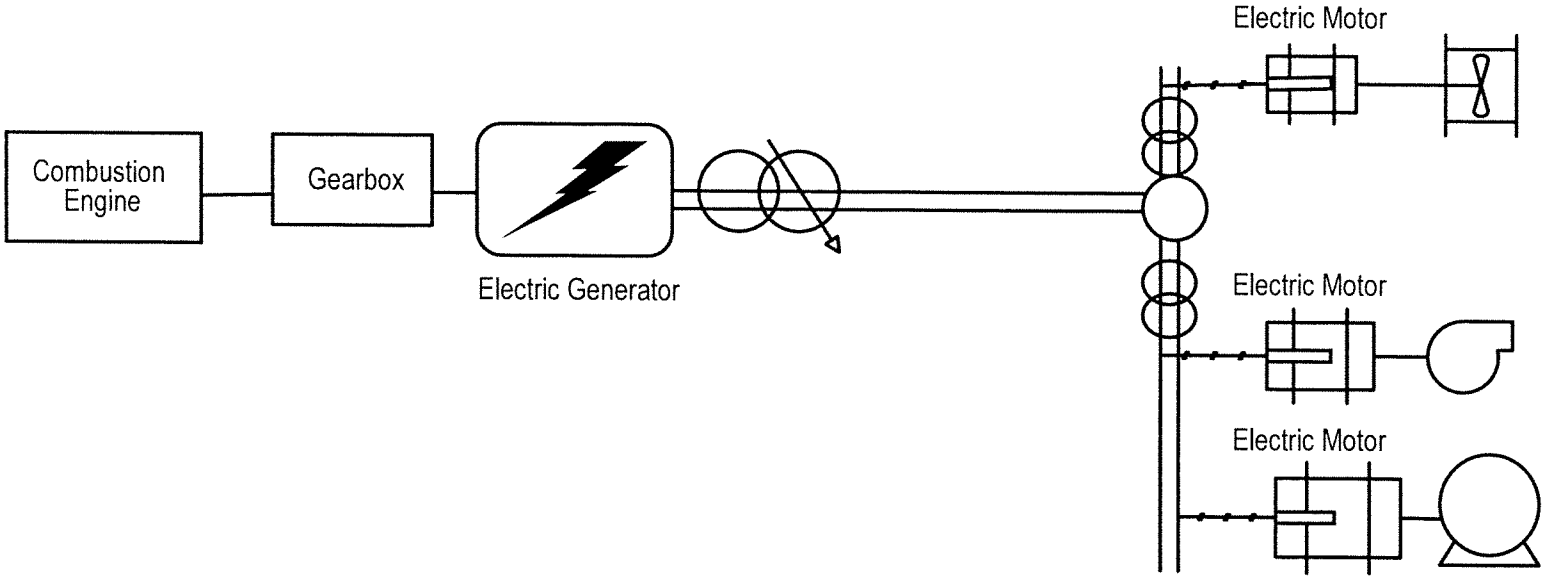
FIG. 1 is a schematic of electricity generation, transmission and distribution, and usage by an EMDS.

FIG. 1 illustrates a typical schematic of electricity generation, transmission and distribution, and usage by EMDS. The electricity generation is employed by fossil fuel-fired power units that currently produce more than 40% of total electricity generated in the United States of America.

Figure 2:
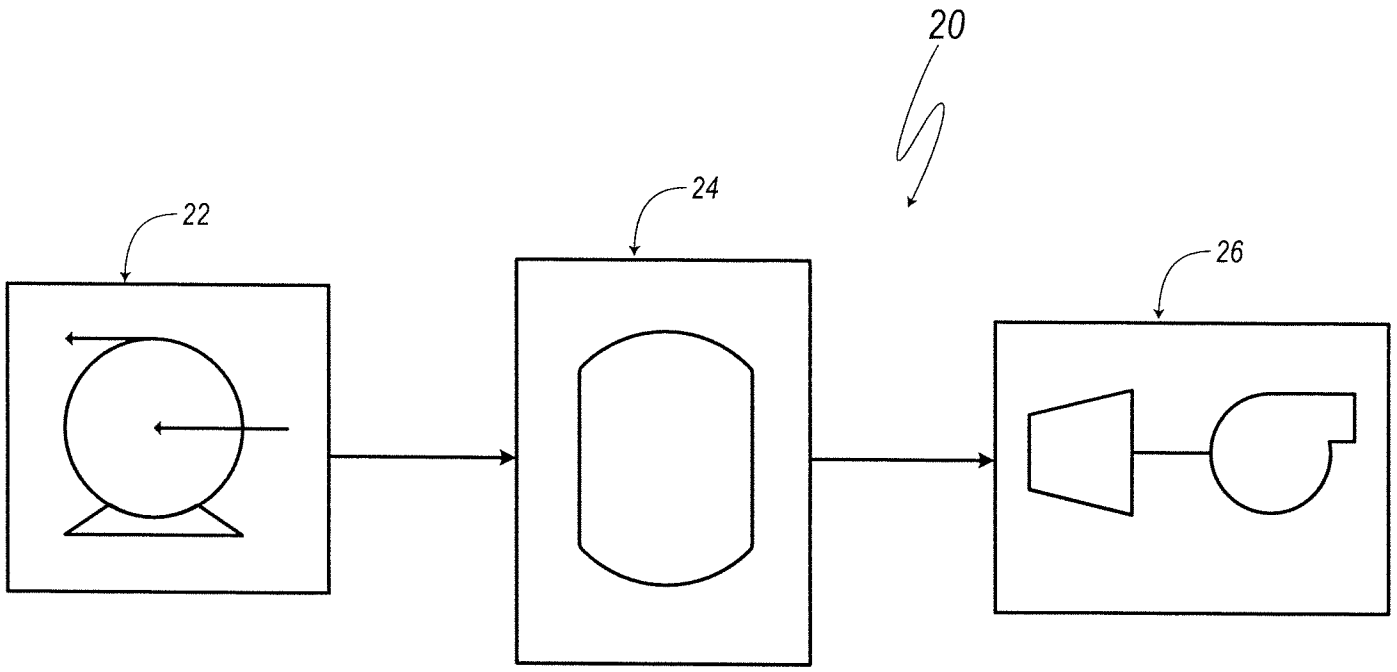
FIG. 2 is a general schematic of a HTDS in accordance with one embodiment of the invention.

FIG. 2 shows a general schematic of a hydro-turbo drive system (HTDS) 20 in accordance with one embodiment of the invention. The HTDS 20 includes at least three modules: Module #1, a HP water generator 22; Module #2, a HP water storage unit 24; and Module #3, hydro-turbo drive(s) 26. Although the term "water" is used throughout the specification, it is possible that other fluids may be substituted although water is presently the preferred fluid for use in the described system.

Preferred operation of the HTDS 20 is described as follows. HP water produced in the HP water generator pump 22 of Module #1 is fed to the storage unit 24 of Module #2, where constant pressure is maintained using a very small amount of compressed air (not shown on this schematic). From the storage unit 24, the HP water is supplied to each of the one or more Module #3 hydro-turbines 26 that provide mechanical power to end-use rotary machineries. Below, descriptions of several embodiments of Module #1 design and modeling results are presented.

With HP water generation in Module #1, various sources of energy can be used to generate high pressure water. Such sources may include the following:

1. Any available waste heat sources from active existing combustion units and other operative equipment;

2. Natural gas, liquid fuel, or renewable fuel (digester and land field gases, etc.) which could be used to fire in gas turbines, reciprocating engines, or any other rotary prime movers; and 3. Existing, currently operative or potentially ready to operate rotary prime movers.

No electricity is necessary to operate any of the HTDS components above. In some cases, an electric motor may be used as a prime mover for a HP water pump. Various ways of using the above-identified energy sources will be described in further detail below.

1. Utilization of Waste Heat for HP Water Generation

Combustion units, (e.g., boilers, furnaces, gas turbines, reciprocating engines, etc.) produce waste heat. In a majority of cases, the waste heat is in the form of flue gases at ambient pressure and temperature in the range from 400° F. up to 1000° F. Common practice has been to use the waste heat for the production of hot water and/or hot air for internal usage.

In accordance with one aspect of the subject invention, such waste heat is desirably utilized for producing HP water which in turn is desirably utilized as a source of mechanical power for hydro-turbine drive systems (HTDS). As will be appreciated by those skilled in the art and guided by the teachings herein provided, HTDS can desirably be utilized as alternatives to widely used electric motor drive systems (EMDS). The replacement of EMDS with HTDS can provide significant reductions in electricity usage and demand, as well as other benefits discussed herein. If hot water and/or hot air need to be produced using waste heat, then a combination of HP water and hot water/air could be generated together. A system where the combination of HP water and hot water/air are generated together is presented below.

Figure 3:
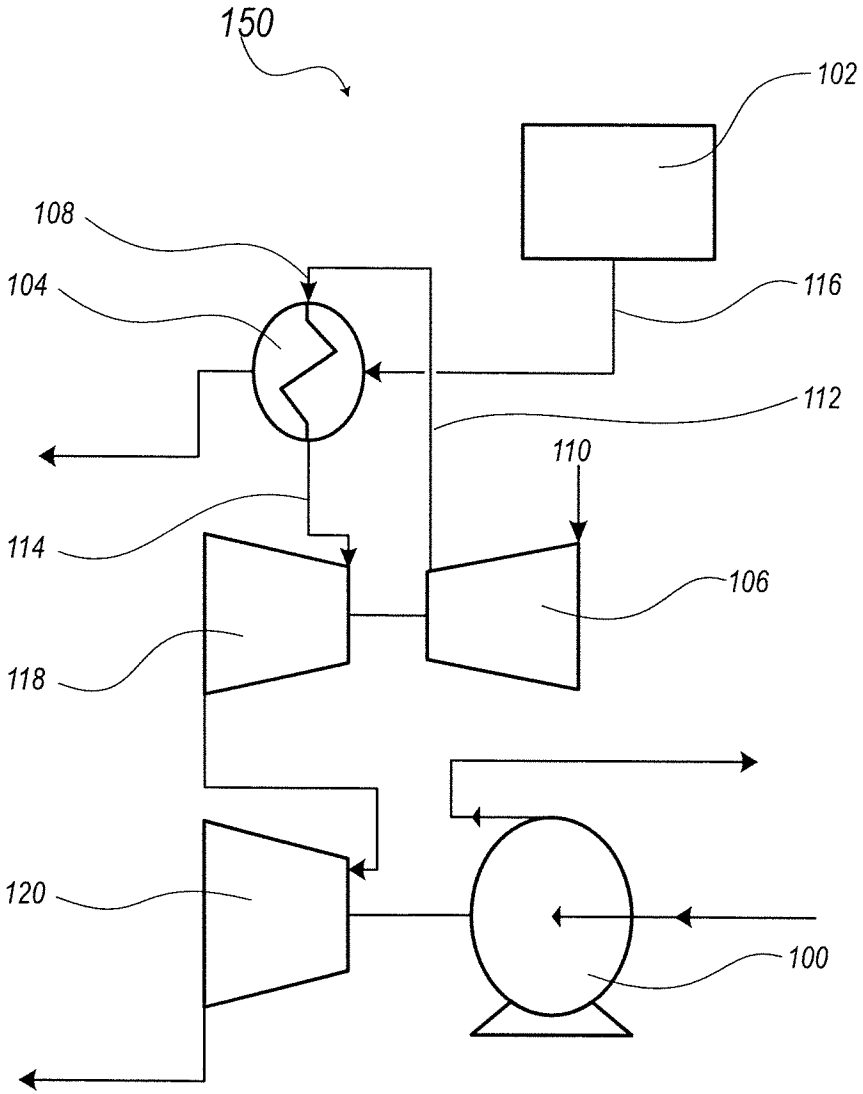
FIG. 3 is a schematic of a HTDS Module #1 for HP water generation from waste heat in accordance with one embodiment of the invention.

FIG. 3 shows a schematic of a HTDS 150 (Module #1) for HP water generation from waste heat 116 in accordance with one embodiment of the invention.

The HTDS 150 preferably comprises a two-stage air turbine 118, 120, a HP water pump 100, and an air heater (AH) 104. Ambient air 110 is compressed in an air compressor 106 and then fed to the AH 104 in the form of compressed air 112. In the AH 104, a portion of waste heat 116 is transferred to compressed air producing hot compressed air (HCA) 114. The HCA 114, functioning as a working fluid, is expanded in a first stage air turbine-1 or expander 118, which drives the air compressor 106. From air-turbine-1 118, the working fluid is fed to a second stage, air turbine-2 120, which produces the required shaft power to drive the HP water pump 100. Exhaust from air turbine-2 120 is warm or almost hot air that may be used for space heating or hot water production.

The HP water generation or Module #1 can be built from commercially available components. For example, the two-stage air turbine 118, 120 can be built from turbochargers such as those broadly used in the automobile industry. The AH 104 design may be a replica of a gas turbine AH and could therefore be sourced from a gas turbine AH manufacturer. Several pump companies could supply the HP water pump 100.

Usually, industrial, water processing, and agriculture facilities have available waste heat 116. A combustion unit 102 firing gaseous fuels can be used as an alternative. The gaseous fuels used with the combustion unit 102 are preferably digester gas, land field gas or natural gas. All of these types of fuel combustion units typically produce in an exhaust stream 242 some waste heat in the form of hot flue gases. In general, the firing rate of the unit 102 and the temperature of the exhaust flue gases define the amount of waste heat 116. The firing rate defines the flow rate, composition, and the temperature (the enthalpy of the exhaust) of the flue gases.

Figure 4:
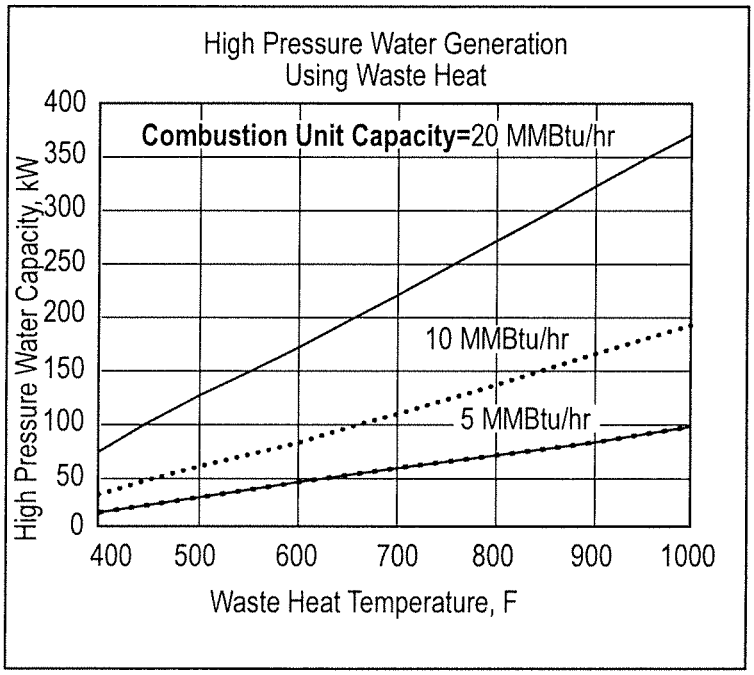
FIG. 4 is a graphical presentation of HP water generation power as a function of combustion unit firing rate and waste heat temperature according to one embodiment of this invention.

ASPEN modeling of the HTDS configuration of Module #1 shown in FIG. 3 was conducted. The exhaust stream from the combustion unit 102 goes to the air heater (AH) 104 where heat is transferred to the compressed air 112. Then the resulting HCA 114 is expanded in turbine-1 118 and turbine-2 120, driving the air compressor 106 and the HP water pump 100, respectively. The modeling scope included three different firing rates: 5, 10 and 20 MMBtu/hr, and variation of the exhaust temperature in the range from 400° F. to 1000° F. All calculations were done at an air/fuel stoichiometric ratio of about 1.5 (~50% excess air and 6.7% $O_2$ in the exhaust), and a pressure ratio in the air compressor 106 is kept in the range of 2.6-3.0 to maintain an appropriate compressed air 112 temperature at an AH inlet 108 leading to the AH 104. More than twenty cases were calculated and the results are presented in FIG. 4 as HP water capacity a function of temperature of the waste heat stream at the three different firing rates of the combustion units.

The modeling results showed the following:

1. When exhaust from a firetube boiler is used with T=400-500° F. then up to 30, 60 and 130 kW of HP water could be produced from boiler waste heat at 5, 10 and 20 MMBtu/hr boiler firing rates.
2. When exhaust from an internal combustion engine (ICE) or combustion gas turbine (GT) is used with exhaust temperature at least 800-900° F. then up to 80, 165 and 320 kW of HP water could be generated from ICE or GT exhaust waste heat at 5, 10 and 20 MMBtu/hr ICE or GT firing rates, respectively.

3. The exhaust from the air turbine-2 120 is slightly pressurized hot air with a temperature of about 150-200° F. when boiler waste heat is used, and 250-300° F. in the case of ICE or GT. This hot air could be applied for space heating, and if needed the hot air together with hot flue gases from the AH 104 could be applied for hot water heating or as a heat source for low temperature economizers for firetube boilers.
4. Thermal efficiency of Module #1, as shown in FIG. 3, was defined as produced HP water hydropower to thermal energy transferred from flue gases to air in the AH 104. The results based on ASPEN modeling show a 25-30% efficiency. The thermal efficiency of the HP water generation module is much higher than the thermal efficiency of an Organic Rankine Cycle which is usually reported at 10-12% at best.
5. The estimated overall capital cost of assembled Module #1, like in FIG. 3, is about 400-600 $/kW due to the low cost of turbocharger machinery.

2. Utilization of Rotary Prime Movers for HP Water Generation

Figure 5:
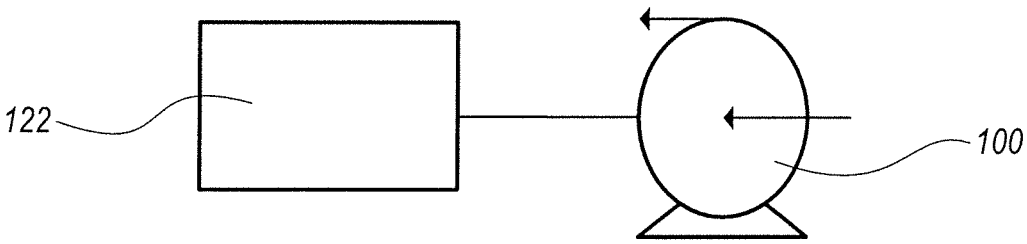
FIG. 5 is a general schematic of a HP water generation Module #1 using rotary prime movers in accordance with one embodiment of the invention.

In another embodiment of this invention, as shown in FIG. 5, the Module #1 includes a coupled rotary prime mover or a thermally driven pump 122 and an HP water pump 100. If an existing prime mover is used then an existing fuel may be used for this embodiment. However, if a new prime mover will be installed, then any of the fuels described in connection with the previous embodiment (e.g., natural gas, liquid fuel, or renewable fuel (digester and land field gases, etc.)) can be used to run the engine. In some cases, an electric motor may serve as the prime mover.

In Table 1 below, the performance results of Module #1 with ICE or GT as the prime movers are shown. Water pump efficiency was increased from 89 to 92%. The prime mover efficiency was assumed from 34.5% to 36%.

TABLE 1

Module #1, ICE/GT - Water Pump, Performance

| | | | | | |
|---|---|---|---|---|---|
| Heat Input | MMBtu/hr | 1 | 3 | 5 | 10 |
| Shaft Power Produced | kW | 101 | 308 | 520 | 1055 |
| Hydro-Power Produced | kW | 90 | 277 | 478 | 981 |

Hydro-Turbine Drive System—Three Possible System Configurations (Versions)

Within the HTDS of this invention, there are three further illustrative embodiments, or versions, of different possible system configurations. Each of these versions will be described in further detail below.

Version 1—Mechanical Power in the Form of HP Water Produced from Fossil or Renewable Fuel, a Fired Combustion Engine, and Waste Heat Converted by an Air Turbine System to mechanical power.

Figure 6:
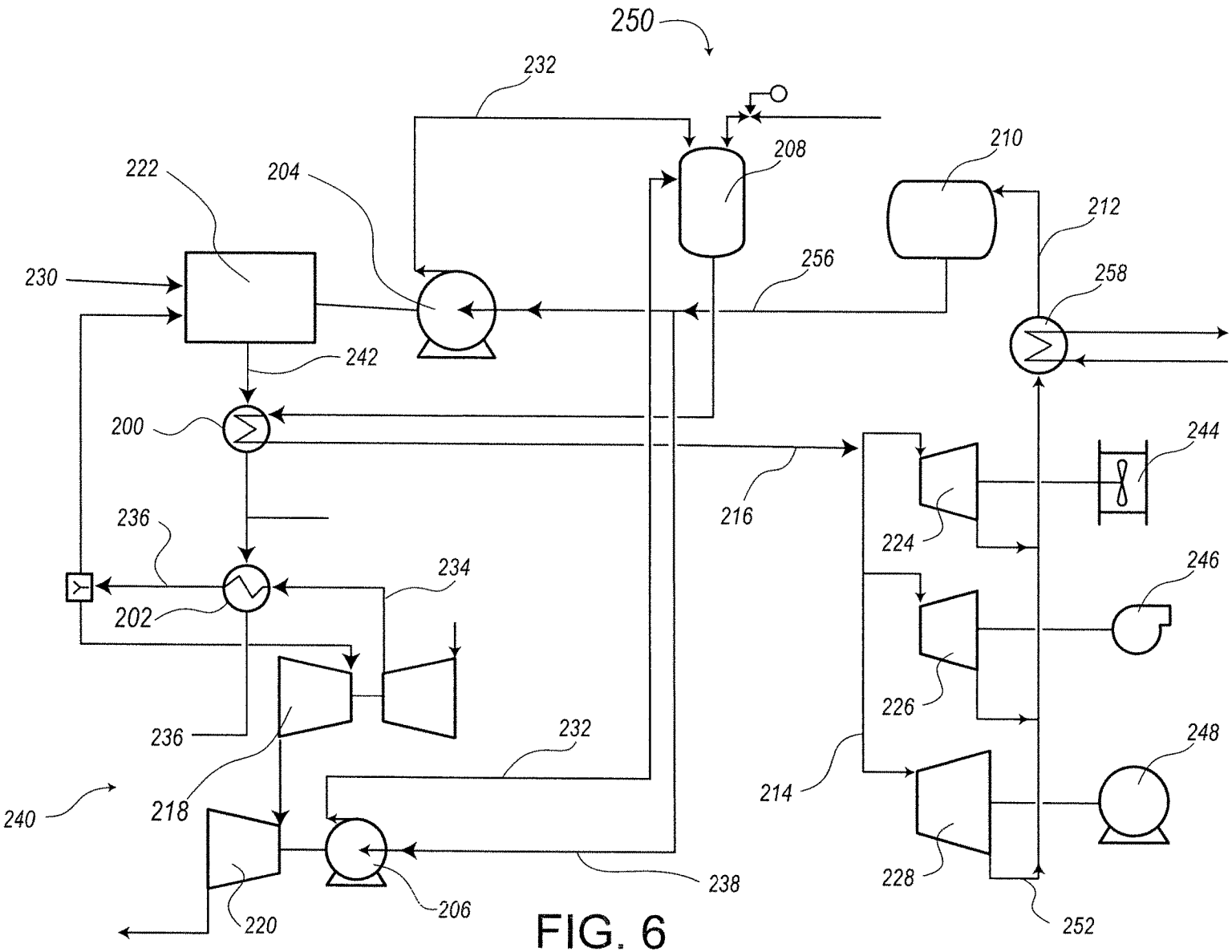
FIG. 6 is a schematic of a hydro-drive system in accordance with one embodiment of the invention.

FIG. 6 is a schematic of a hydro-drive system in accordance with Version 1. In this embodiment, a hydro-power generation unit 250 has two HP water pumps 204, 206. A rotary combustion engine firing fossil or renewable fuel 230 drives pump-1 204. An air turbine unit 240 using waste heat 242 energy from a combustion engine 222 exhaust drives another pump-2 206. HP water 232 (or other liquid) is collected in a HP storage unit 208 from which the HP water 232 is supplied to hydro-drives 224, 226, 228 (hydro-turbines). Each of the hydro-drives 224, 226, 228 are directly (or thru a gearbox) connected to an end-use rotary unit 244, 246, 248 and provides the required mechanical power for that unit. The end-use rotary units 244, 246, 248 may be, but are not limited to, blowers 244, gas or air compressors 246 and pumps 248.

In the suggested system shown in FIG. 6, the following energy conversions and losses associated with EMDS are eliminated: i) mechanical power to electrical power in a generator; ii) changes in electrical parameters (voltage, frequency, AC to DC and DC to AC, etc.); iii) friction in moving parts; and iv) conversion of electric energy to mechanical energy by an electric motor. The proposed hydro-drive system is much simpler and more energy efficient. The HTDS energy losses are associated with conversion of mechanical power to hydropower in an HP pump, and conversion of hydropower to mechanical power in a hydro-turbine. Small losses are expected in HP 214 and LP pipelines 212 due to low water velocity. The estimated efficiency of fuel energy to mechanical energy to the end-use rotary unit 244, 246, 248 is about 29-33%. The HTDS is more efficient than EMDS during startup (no startup elevated current, many rotary units may be started simultaneously without any additional losses, etc.), loading and any upset conditions. HTDS also surpass EMDS in terms of safety.

The HTDS version shown in FIG. 6 includes other various features and improvements. HP water is preheated and undergoes partial evaporation to produce a fluid and vapor (water/vapor) mixture 216. ASPEN modeling shows a significant increase in a mechanical shaft power 252 produced by the hydro-turbines 224, 226, 228 when the water/vapor mixture 216 was used as a working fluid compared to water only. ASPEN modeling results are presented in details below in a dedicated section. Here as an example, when a 90% water and 10% vapor (steam) mixture is used as a working fluid, the power 252 produced by a hydro-turbine, kW/lb working fluid, is 5 times greater than when working fluid is 100% water.

Figure 7:
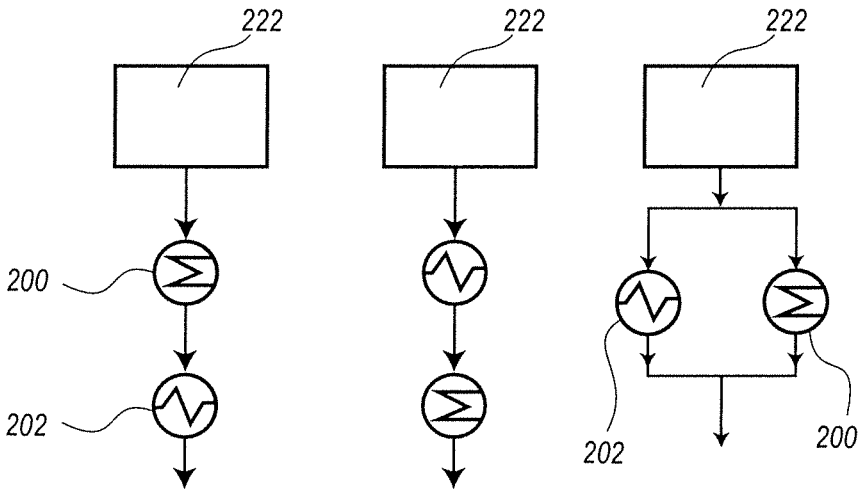
FIG. 7 is a schematic representation of location options for a water heater and evaporator, and an air heater in accordance with the embodiment of FIG. 6.

Compressed air 234 preheating to a maximum possible temperature, and use of hot compressed air (HCA) 236 as a working fluid in the air turbine unit 240 to produce additional hydro power by a coupled first air turbine or air expander 218 and a second air turbine 220, with the second water pump 206. Additional hydro power may also be produced from a first fluid/water heater 258. In FIG. 6, the location of a second fluid or water heater and evaporator (WH&E) 200 and AH 202 are shown in series. There is also the possibility of at least two more different configurations, when the units are located in opposite series AH-WH&E, or in parallel. In FIG. 7, schematics of those three versions are shown and modeling results are shown below.

Closed loop high pressure 232 and low pressure 238 water is circulated in the HTDS. LP water 238 from a LP storage unit 210 is fed to an inlet 254 of the HP pump 204, then HP water 232 is fed to the HP storage unit 208. The HP water is then supplied to multiple hydro-turbines 224, 226, 228 where mechanical power 252 is generated to drive the rotary machineries 244, 246, 248, and finally the LP water 238 from hydro-turbine exhaust is fed to the LP water storage unit 210 closing the high/low pressure water loop.

Hydro power in the form of HP water 232 is produced on site from available waste heat 242 or other energy source, and the hydro power is immediately used to generate mechanical power to drive end-use rotary machineries 244, 246, 248.

There is cogeneration of hydro power, for driving rotary machinery, and of hot water and/or hot air for internal usage. In addition to hot air from air turbine exhaust and hot flue gases from AH exhaust, the hydro-turbine exhaust also contains thermal energy in the hot water and some steam that could also be used for hot water and/or hot air for internal usage. Estimated parameters of HTDS with all above-mentioned features are shown below where modeling results are discussed.

This Version 1 has the highest capacity (produced power to energy input, kW/Btu-hr), as well as highest thermal efficiency approaching 75-80% LHV in combined heat and power (CHP) mode operation.

More than 20 cases of ASPEN models were calculated. The major variables included:

1. Combustion unit firing rate from 1 to 10 MMBtu/hr, and exhaust temperature from 400 to 1100° F.;
2. Vapor fraction in the water/steam mixture at the exit from WH&E, from 0 to 20%;
3. Pressure of the HP water after HP water pumps, up to 400 psi; and
4. Pressure ratio in the air turbine, from 2 to 10; and some other parameters.

Detailed calculations were conducted for a combustion unit with a firing rate of about 1 MMBtu/hr and 900° F. exhaust temperature. The combustion unit was considered as an ICE with internal heat losses of 33.5%, and overall unit thermal efficiency of 35.4%.

Below in Table 2, the initial data and calculation results are presented for five cases. In cases 1A thru 4A, the main variable was vapor fraction in the water-steam mixture 216 after WH&E 200, and accordingly the redistribution of the waste heat 242 from the overall hydro-power generation unit exhaust between air turbine unit 240 and hydro-turbines 224, 226, 228 as well as changes in temperature and pressure in the HTDS associated with the amount of heat consumed by the WH&E 200 and AH 202. The locations of the WH&E and AH were in series, see FIGS. 6 and 7. In case 5A compared to case 3A, the HP water 232 pressure was increased from 117 to 234 psia. The purpose of this case is to show the effect of HP water 232 pressure on the HTDS performance.

TABLE 2

Initial Data and Calculation Results for five HTDS Cases

| Parameters | | Values | | | | |
|---|---|---|---|---|---|---|
| Schematic | Units | 4A | 2A | 1A | 3A | 5A |
| Water Mass FR, Tot | lb/hr | 1000 | 1000 | 1000 | 1000 | 1000 |
| Number of streams | — | 2 | 2 | 2 | 2 | 2 |
| Water Mass FR, Stream | lb/hr | 500 | 500 | 500 | 500 | 500 |
| Combustion Unit Heat Input | MMBtu/hr | 1.02 | 1.02 | 1.02 | 1.02 | 1.02 |
| | kW | 298.6 | 298.6 | 298.6 | 298.6 | 298.6 |
| Combustion Unit Heat Output (Waste) | kW | 92.9 | 92.9 | 92.9 | 92.9 | 92.9 |
| Combustion Unit Heat losses | % | 33.5 | 33.5 | 33.5 | 33.5 | 33.5 |
| | kW | 100.0 | 100.0 | 100.0 | 100.0 | 100.0 |
| Combustion Unit Temp Outlet | | 900 | 900 | 900 | 900 | 900 |
| Combustion Unit EA (exhaust O2) | | 1.5(6.7) | 1.5(6.7) | 1.5(6.7) | 1.5(6.7) | 1.5(6.7) |
| Combustion Unit Power Output | kW | 105.7 | 105.7 | 105.7 | 105.7 | 105.7 |
| Air Turbine Inlet Temp, TIT | ° F. | 765 | 396 | 317 | 194 | 240 |
| Air Turbine Inlet Pressure, TIP | psia | 47 | 38 | 38 | 29 | 20 |
| Air Turbine Outlet Temp | ° F. | 407 | 180 | 119 | 68 | 70 |
| Hydro-Turbine1 Inlet Vapor (Steam) | Mole Frac | 0 | 0.06 | 0.12 | 0.21 | 0.197 |
| Hydro-Turbine1 Inlet Temp | ° F. | 160 | 340 | 340 | 340 | 395 |
| Hydro-Turbine1 Inlet Pres | psia | 117 | 117 | 117 | 117 | 234 |
| H-Turbine1-exh Vapor | Mole Frac | 0 | 0.19 | 0.23 | 0.3 | 0.34 |
| H-Turbine1-Exh Temp | ° F. | 160 | 216 | 216 | 216 | 216 |
| H-Turbine1-Exh Press | psia | 15 | 15 | 15 | 15 | 15 |
| H-Turbine2-exh Vapor | Mole Frac | 0.01 | 0.23 | 0.27 | 0.32 | 0.36 |
| H-Turbine2-Exh Temp | ° F. | 145 | 145 | 145 | 145 | 145 |
| H-Turbine2-Exh Press | psia | 3 | 3 | 3 | 3 | 3 |
| Power Output Air Turbine | kW | 9.35 | 2.48 | 1.15 | 0.03 | 0.04 |
| Power Output Hydro-Turbine1 | kW | 0.1 | 1.22 | 2.34 | 4.05 | 4.48 |
| Power Output Hydro-Turbine2 | kW | 0.04 | 3.84 | 4.68 | 5.82 | 6.52 |
| Power Output Hydro-Turbine Total | kW | 0.14 | 5.06 | 7.02 | 9.87 | 11 |
| Pump Power | kW | 0.12 | 0.12 | 0.12 | 0.12 | 0.25 |
| Hydro-Turbine power (no vapor/steam) | kW | 0.05 | 0.05 | 0.05 | 0.05 | 0.1 |
| Total Power Output, Air Turbine + Hydro-Turbine | kW | 9.49 | 7.54 | 8.17 | 9.9 | 11.04 |
| Available Heat for CHP, tot | kW | 107.2 | 92.1 | 109.0 | 107.21 | 105.82 |
| Hydro-Turbine Exhaust | kW | 14.1 | 46.6 | 52.7 | 61.75 | 67.11 |
| Air Turbine Exhaust | kW | 21.6 | 0.1 | 3.1 | 0.16 | 0.02 |
| Air Heater Flue Gases Exhaust | kW | 71.5 | 45.4 | 53.1 | 45.31 | 38.69 |
| Heat Inlet for PowerGen | | | | | | |

TABLE 2-continued

Initial Data and Calculation Results for five HTDS Cases

| Parameters | | Values | | | | |
|---|---|---|---|---|---|---|
| Schematic | Units | 4A | 2A | 1A | 3A | 5A |
| Air Turbine | kW | 31.3 | 9.9 | 4.6 | 0.1 | 0.26 |
| Hydro-Turbine | kW | 12.6 | 50.0 | 58.0 | 70.0 | 76.39 |
| Tot heat for powerGen | kW | 44.0 | 59.9 | 62.6 | 70.1 | 76.6 |
| HTDS Performance | | | | | | |
| Hydro-Turbine Power per 1000 lb/hr Water | kW/Klb/hr | 0.28 | 10.12 | 14.04 | 19.74 | 22 |
| Water Pump Power per 1000 lb/hr Water | kW/Klb/hr | 0.12 | 0.12 | 0.12 | 0.12 | 0.25 |
| Hydro-Turbine Power/W-Pump Power | | 2.33 | 84.33 | 117.00 | 164.50 | 88.00 |
| Hydro-Turbine 2 Power/W-Pump Power | | 0.83 | 0.83 | 0.83 | 0.83 | 0.80 |
| Thermal Efficiencies: | | | | | | |
| Combustion Unit only | % | 35.4 | 35.4 | 35.4 | 35.4 | 35.4 |
| HTDS w/o CHP | % | 38.6 | 39.6 | 40.5 | 42.0 | 42.8 |
| CHP Efficiency | % | 85 | 85 | 85 | 85 | 85 |
| HTDS w/ CHP | % | 69.1 | 65.8 | 71.5 | 72.5 | 72.9 |

Figure 8:
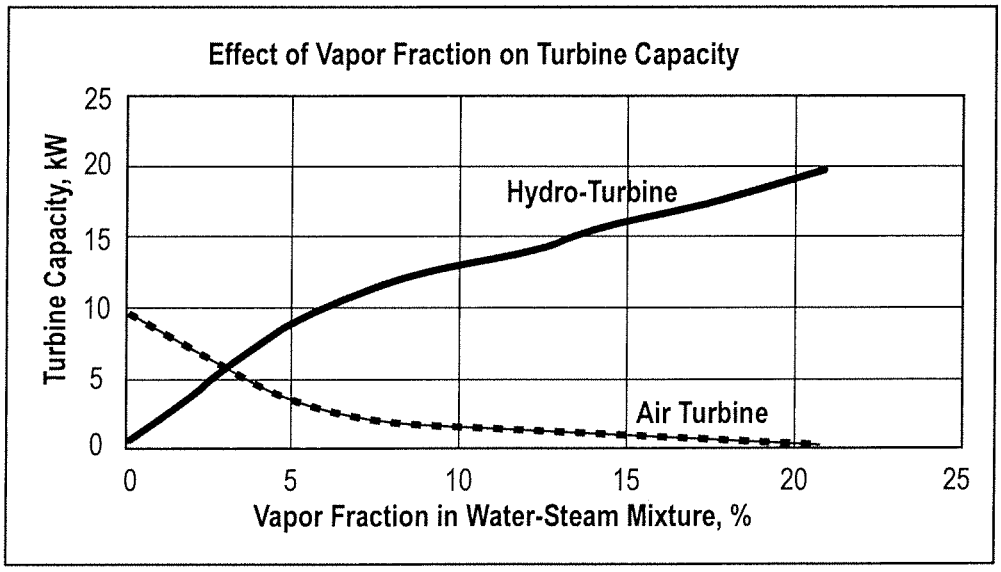
FIG. 8 is a graphical presentation of Air Turbine and Hydro-Turbine Capacities vs. Vapor Fraction in Working Fluid, in accordance with the embodiment of FIG. 6.
Figure 9:
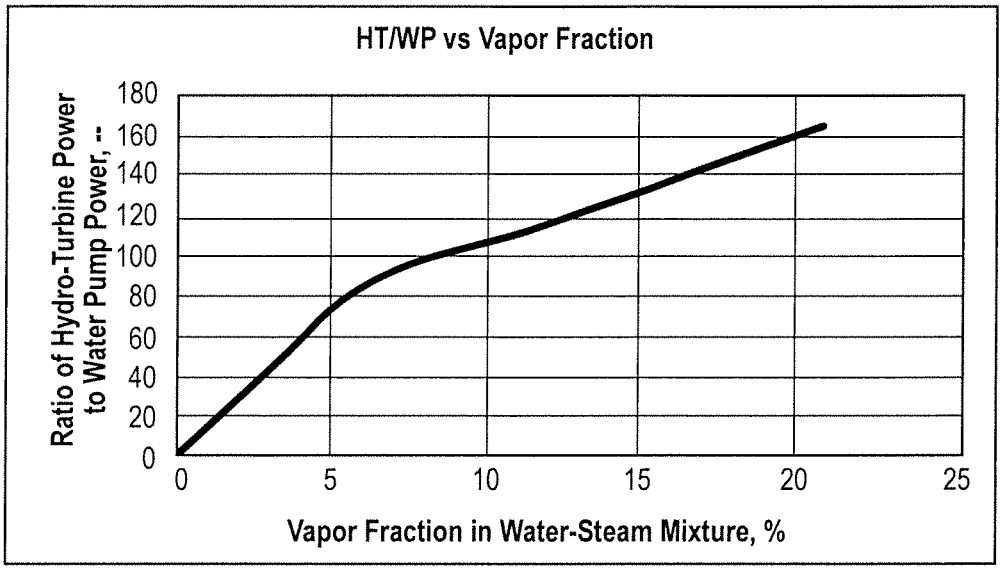
FIG. 9 is a graphical presentation of the Ratio of Hydro-Turbine Power to Water Pump Power as a function of Vapor Fraction in Working Fluid, in accordance with the embodiment of FIG. 6.

One of the most important results of the ASPEN modeling was the quantitative effect of the steam (vapor) fraction on hydro-turbine produced power. In FIG. 8 and Table 3 below, the effect of vapor fraction in working fluid (water/vapor mixture) on both air turbine and hydro-turbine capacities is presented. As the vapor fraction increases, the hydro-turbine (HT) capacity raises significantly. At no vapor (i.e. water only) in working fluid, the HT power was only 0.10 kW per 1000 lb/h working fluid, and at 6% vapor the power went up to 10.12 kW, a 100 fold increase (see Table 3).

TABLE 3

Air Turbine (AT), Hydro-Turbine (HT) and Water Pump Powers, kW/(Klb/h), and HT to WP ratio vs. Vapor Fraction

| | Vapor Fraction, % | | | |
|---|---|---|---|---|
| | 0 | 6 | 12 | 21 |
| AT, kW/(Klb/h) | 9.35 | 2.48 | 1.15 | 0.03 |
| HT, kW/(Klb/h) | 0.10 | 10.12 | 14.04 | 19.74 |
| WP, kW/(Klb/h) | 0.12 | 0.12 | 0.12 | 0.12 |
| HT/WP. kW/kW | 0.83 | 84.3 | 117 | 164.5 |

At the same time, the air turbine (AT) power decreased from almost 10 kW to almost zero at 20% vapor. The reasons for this are as follows:

1. The amount of available waste heat 216 from combustion unit 222 exhaust was the same for all cases and is not dependent on the vapor fraction in working fluid; and 2. The locations of the WH&E and AH were in series, see FIGS. 6 and 7, and as soon as the vapor fraction increased, the heat consumption by WH&E went up and less heat was left for the air heater. Accordingly, less power could be produced by the AT unit 240. At about 20% of vapor fraction, the flue gas temperature became so low (only a few degrees above compressed air temperature) that no heat could be transferred to the compressed air 234 and no power could be transferred from the AT unit 240. The distribution of the amount of heat transferred to the WH&E 200 and the AH 202 could be used as a method for controlling the power produced by hydro-turbines 224, 226, 228 and the air turbines 218, 220.

With vapor fraction increase, the hydro turbine to water pressure power ratio went up to more than 100. This means that with very little power for water pressure, for example water pressure power=1 kW, the hydro-turbines would be capable to drive up to 100 kW of rotary machinery. This is a significant feature of the subject HTDS.

Version 2—Energy to produce Mechanical Power in the form of HP Water comes from Fossil or Renewable Fuel through the coupled Combustion Engine and HP Water Pump.

Figure 10:
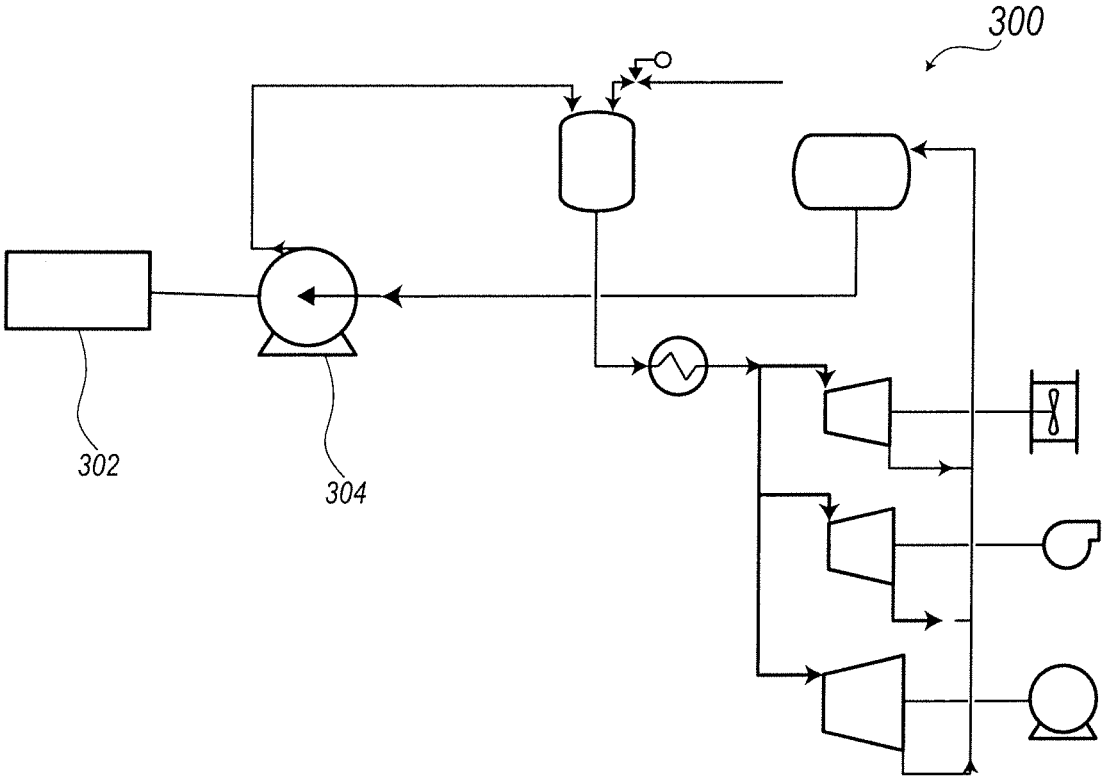
FIG. 10 is a general schematic of a hydro-drive system, in accordance with an alternative embodiment of the invention.

FIG. 10 presents a general schematic of a hydro-drive system 300, in accordance with another embodiment of this invention.

In Version 2, fossil or renewable fuel is fired and a combustion engine 302 is directly connected and provides required mechanical power to a HP water pump 304. The remaining components of the HTDS 300 are compatible with those in Version 1.

Version 3—Waste Heat is Used to Produce Mechanical Power Carried by HP Water

Figure 11:
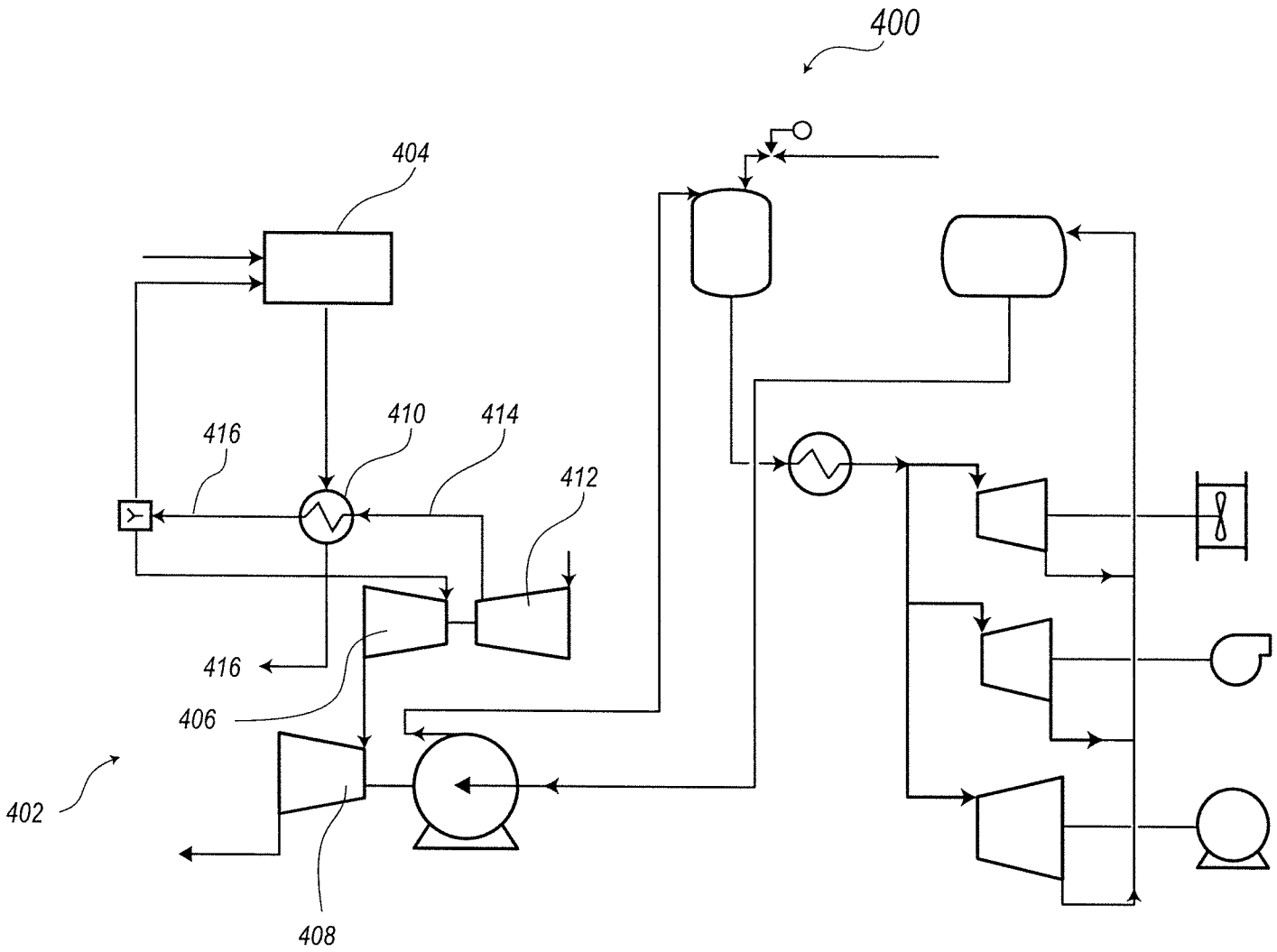
FIG. 11 is a general schematic of a hydro-drive system, in accordance with yet another alternative embodiment of the invention.

Another version of a proposed HTDS 400, Version 3, is presented in FIG. 11. In this case, an exhaust thermal energy (waste heat) is utilized to produce mechanical power via an air turbine system (ATS) 402. The ATS 402 includes a two-stage air turbine 406, 408 and an air heater (AH) 410. A $1^{st}$ stage of the air turbine 406 drives an air compressor 412 which supplies compressed air 414 to the AH 410, and then a hot compressed air 416 is fed to the $1^{st}$ air turbine 406 and (optionally) to a combustion unit 404. The remaining components of the HTDS 400 are compatible with those in Version 1.

Technical performance of Module #1 related to this version is presented and discussed in the previous section. When the prime mover firing rate was 5, 10, or 20 MMBtu/hr, the resulting produced hydro-power was about 80, 165 and 320 kW, respectively.

While in the foregoing detailed description this invention has been described in relation to certain preferred embodiments thereof, and many details have been set forth for purposes of illustration, it will be apparent to those skilled in the art that the invention is susceptible to additional embodiments and that certain of the details described herein can be varied considerably without departing from the basic principles of the invention.

The invention claimed is:

1. A method of driving a rotary machinery end use unit directly or through a gearbox connected to the rotary machinery unit, the method comprising:

producing a high pressure (HP) fluid by at least one HP fluid pump driven by at least one prime mover, wherein the at least one prime mover is a thermally driven pump;

adding vapor to the HP fluid wherein a HP fluid/vapor mixture is formed to include less than 20% vapor;

supplying the HP fluid/vapor mixture to at least one hydro-turbine and producing mechanical shaft power; and transferring the mechanical shaft power from the hydro-turbine to the rotary machinery end-use unit.

2. The method of claim 1 wherein the HP fluid is supplied to a second fluid heater and evaporator adapted for preheating the HP fluid to a boiling temperature and thereby partially evaporating the HP fluid wherein the partially evaporated HP fluid forms the HP fluid/vapor mixture.

3. The method of claim 1 wherein the HP fluid is supplied to a HP fluid storage unit where a stable pressure is maintained.

4. The method of claim 1 wherein a low pressure (LP) fluid is supplied to an inlet of the HP fluid pump to close a system fluid loop.

5. The method of claim 1 wherein the LP fluid from the at least one hydro-turbine is supplied to a LP fluid storage unit.

6. The method of claim 1 wherein the fluid is water.

7. The method of claim 1 wherein the fluid/vapor mixture includes about 5-20% vapor.

8. The method of claim 2, wherein energy for the at least one prime mover is provided by waste heat from a combustion unit exhaust upstream of the second fluid heater and evaporator.

9. The method of claim 8 wherein the combustion unit is a combustion unit with an exhaust temperature of at least 400° F.

10. The method of claim 8, wherein the combustion unit is a gas turbine, an internal combustion engine, or a boiler.

11. The method of claim 1, wherein the rotary machinery end-use unit is a pump, a blower, or a compressor.

12. A method of driving a rotary machinery end use unit directly or through a gearbox connected to the rotary machinery unit, the method comprising:

producing a high pressure (HP) fluid by one of at least one HP fluid pump driven by at least one prime mover, wherein the prime mover is an air turbine unit further comprising an air compressor, an air heater and an air expander;

adding vapor to the HP fluid wherein a HP fluid/vapor mixture is formed to include less than 20% vapor;

supplying the HP fluid/vapor mixture to at least one hydro-turbine and producing mechanical shaft power; and transferring the mechanical shaft power from the hydro-turbine to the rotary machinery end-use unit.

13. The method of claim 12, wherein heat from a combustion unit is transferred to compressed air in the air heater, raising the temperature of the compressed air forming hot compressed air.

14. The method of claim 12, wherein the fluid heater and evaporator is located in series with the air heater, and wherein the fluid heater and evaporator is located first and the air heater is located second in an exhaust stream from the combustion unit.

15. The method of claim 12, wherein the fluid heater and evaporator is located in series with the air heater, and the air heater is located first and fluid heater and evaporator is located second in the exhaust stream of the combustion unit.

16. The method of claim 12, wherein the fluid heater and evaporator is located in parallel with the air heater in the exhaust stream of the combustion unit.

17. A system for driving rotary machineries with a hydro-power generation unit connected to a rotary machinery unit comprising:

a HP water produced by at least one of a HP water pump and a first fluid heater;

a prime mover adapted to drive the HP water pump, wherein the prime mover is a thermally driven pump;

a HP fluid/vapor mixture formed by a vapor added to the HP water and includes less than 20% vapor; and at least one hydro-turbine connected to the rotary machinery unit adapted to receive the HP fluid/vapor mixture.

18. The system of claim 17, wherein energy for at least one of the prime mover and the first fluid heater is provided by waste heat from a combustion unit.

19. The system of claim 18, wherein the combustion unit has an exhaust temperature of at least 400° F.

20. The system of claim 17, wherein an air turbine unit adapted to receive air from a water heater and evaporator and an air heater acts as the prime mover and further comprises an air compressor, the air heater and an air turbine expander.

21. The system of claim 18, wherein heat from an exhaust stream of the combustion unit is transferred to compressed air in the air heater resulting in hot compressed air at the exhaust temperature of at least 400° F.

22. The system of claim 20, wherein the water heater and evaporator is located in series with the air heater, and the water heater and evaporator is located first and the air heater second in a combustion unit exhaust stream.

23. The system of claim 20, wherein the water heater and evaporator is located in series with the air heater, and the air heater is located first and the water heater and evaporator second in a combustion unit exhaust stream.

24. The system of claim 20, wherein the water heater and evaporator is located in parallel with the air heater in a combustion unit exhaust stream.

25. The system of claim 17, wherein a closed loop high/low pressure water is circulated in the hydro-power generation unit wherein a low pressure water is fed to a first HP pump;

high pressure water is fed to a HP water storage unit;

the high pressure water is supplied from the HP pump or the HP water storage unit to the at least one hydro-turbine, wherein the at least one hydro-turbine is adapted to generate mechanical powers to drive the rotary machinery; and the low pressure water from hydro-turbine exhaust is fed to a LP water storage unit or directly to an inlet on the HP pump thereby closing the high/low pressure water loop.

26. The method of claim 17 wherein the fluid/vapor mixture includes at least 5% vapor.

27. A method of driving a rotary machinery end-use unit directly or through a gearbox connected to the rotary machinery unit, the method comprising:

producing a high pressure (HP) fluid by one of at least one HP fluid pump driven by at least one prime mover, wherein energy for the at least one prime mover is provided by waste heat from a combustion unit exhaust upstream of the second fluid heater and evaporator;

adding vapor to the HP fluid to form a HP fluid/vapor mixture;

supplying the HP fluid/vapor mixture to at least one hydro-turbine and producing mechanical shaft power; and transferring the mechanical shaft power from the hydro-turbine to the rotary machinery end-use unit.

28. The method of claim 27 wherein the at least one prime mover is a thermally driven pump.

29. A method of driving a rotary machinery end-use unit directly or through a gearbox connected to the rotary machinery unit, the method comprising:

producing a high pressure (HP) fluid by one of at least one HP fluid pump driven by at least one prime mover, wherein the prime mover is an air turbine unit further comprising an air compressor, an air heater and an air expander;

adding vapor to the HP fluid wherein a HP fluid/vapor mixture is formed;

supplying the HP fluid/vapor mixture to at least one hydro-turbine and producing mechanical shaft power; and transferring the mechanical shaft power from the hydro-turbine to the rotary machinery end-use unit.

* * * * *